US005318055A

United States Patent [19]

Olaniyan

[11] Patent Number: 5,318,055

[45] Date of Patent: Jun. 7, 1994

[54] SHOULDER SUPPORTED UMBRELLA APPARATUS

[76] Inventor: Olajide O. Olaniyan, 9101 Glenville Rd., Silver Spring, Md. 20901

[21] Appl. No.: 130,690

[22] Filed: Oct. 4, 1993

[51] Int. Cl.[5] ..... A45B 3/00

[52] U.S. Cl. ..... 135/16; 135/21

[58] Field of Search ..... 135/15.1, 16, 20.1, 135/21

[56] References Cited

U.S. PATENT DOCUMENTS

| | | | |
|---|---|---|---|
| 2,496,769 | 2/1950 | Battle | 135/16 X |
| 2,673,086 | 3/1954 | Brown, Sr. | 135/16 X |
| 2,764,993 | 10/1956 | Wallace et al. | 135/20.1 X |
| 3,204,650 | 9/1965 | Shineu | 135/16 |
| 3,554,203 | 1/1971 | Hall, Sr. . | |
| 3,765,434 | 10/1973 | Riggs | 135/20.1 |
| 4,148,102 | 4/1979 | Ying-Yu . | |
| 4,188,965 | 2/1980 | Morman | 135/16 |
| 4,675,916 | 6/1987 | Orsini . | |

*Primary Examiner*—Carl D. Friedman
*Assistant Examiner*—Lan C. Mai
*Attorney, Agent, or Firm*—E. Michael Combs

[57] ABSTRACT

A support container includes a plurality of link members, with the outermost link member having a semi-annular array of ribs projecting therefrom, wherein the ribs are arranged in a pivotal relationship about a platform, the ribs mounting an umbrella web, whereupon a pull cable permits the retraction of the link members and the ribs within the support container.

2 Claims, 4 Drawing Sheets

SHOULDER SUPPORTED UMBRELLA APPARATUS

BACKGROUND OF THE INVENTION

1. Field of the Invention

The field of invention relates to umbrella structure, and more particularly pertains to a new and improved shoulder supported umbrella apparatus arranged for compaction within an associated container and projection therefrom during periods of use.

2. Description of the Prior Art

Various umbrella structure are utilized in the prior art, wherein U.S. Pat. No. 4,148,102 sets forth an umbrella-like hat structure. U.S. Pat. No. 4,675,916 sets forth a further example of an umbrella hat structure.

U.S. Pat. No. 3,554,203 sets forth an umbrella arranged for projection relative to a shoulder harness framework for mounting an individual's torso.

The instant invention attempts to overcome deficiencies of the prior art by providing for a container arranged for shoulder mounting to an individual and in this respect, the present invention substantially fulfills this need.

SUMMARY OF THE INVENTION

In view of the foregoing disadvantages inherent in the known types of umbrella apparatus now present in the prior art, the present invention provides a shoulder supported umbrella apparatus permitting the projection of an umbrella structure relative to an individual when mounted to the individual's shoulder. As such, the general purpose of the present invention, which will be described subsequently in greater detail, is to provide a new and improved shoulder supported umbrella apparatus which has all the advantages of the prior art umbrella apparatus and none of the disadvantages.

To attain this, the present invention provides a support container including a plurality of link members, with the outermost link member having a semi-annular array of ribs projecting therefrom, wherein the ribs are arranged in a pivotal relationship about a platform, the ribs mounting an umbrella web, whereupon a pull cable permits the retraction of the link members and the ribs within the support container.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U. S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shoulder supported umbrella apparatus which has all the advantages of the prior art umbrella apparatus and none of the disadvantages.

It is another object of the present invention to provide a new and improved shoulder supported umbrella apparatus which may be easily and efficiently manufactured and marketed.

It is a further object of the present invention to provide a new and improved shoulder supported umbrella apparatus which is of a durable and reliable construction.

An even further object of the present invention is to provide a new and improved shoulder supported umbrella apparatus which is susceptible of a low cost of manufacture with regard to both materials and labor, and which accordingly is then susceptible of low prices of sale to the consuming public, thereby making such shoulder supported umbrella apparatus economically available to the buying public.

Still yet another object of the present invention is to provide a new and improved shoulder supported umbrella apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
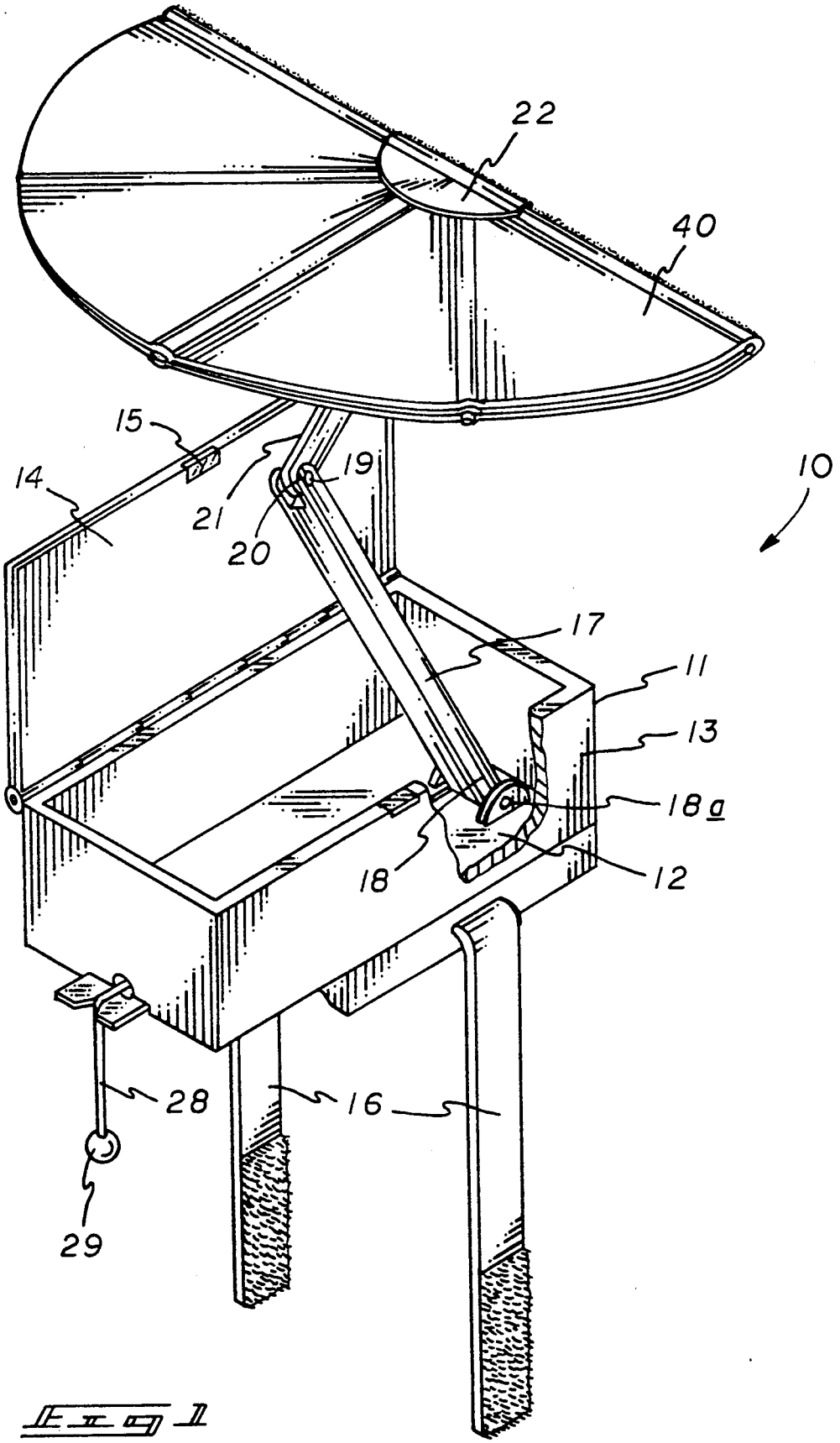
FIG. 1 is an isometric illustration of the invention.
Figure 2:
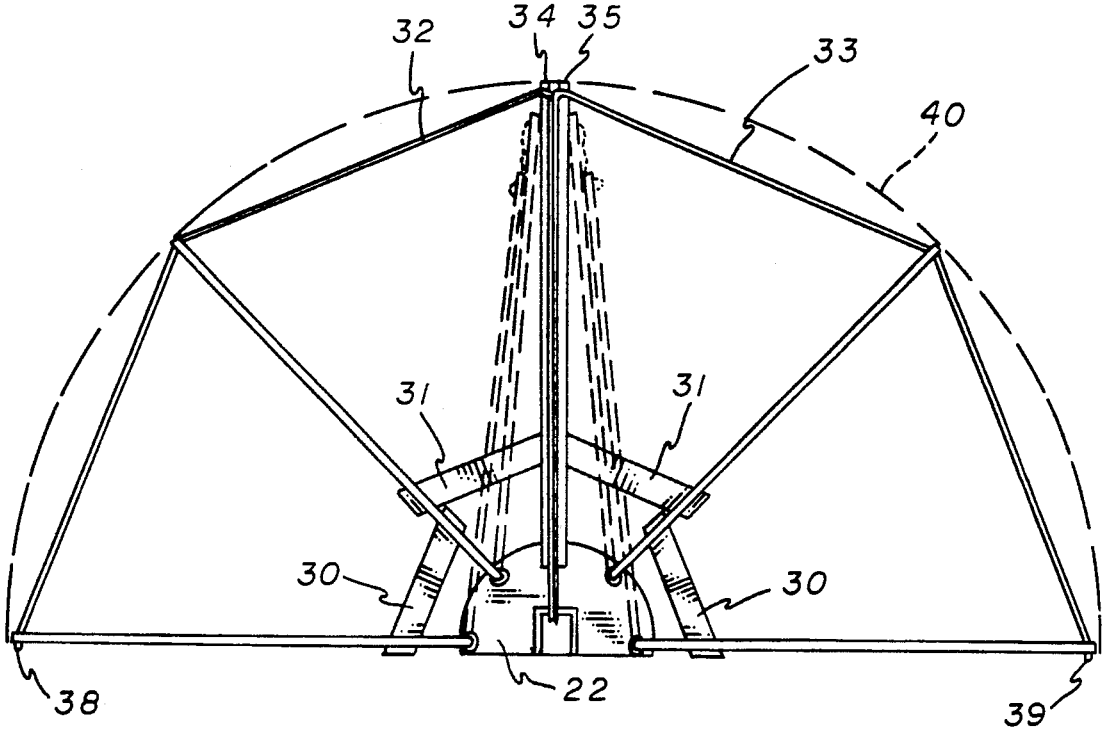
FIG. 2 is an orthographic top view of the rib structure.
Figure 3:
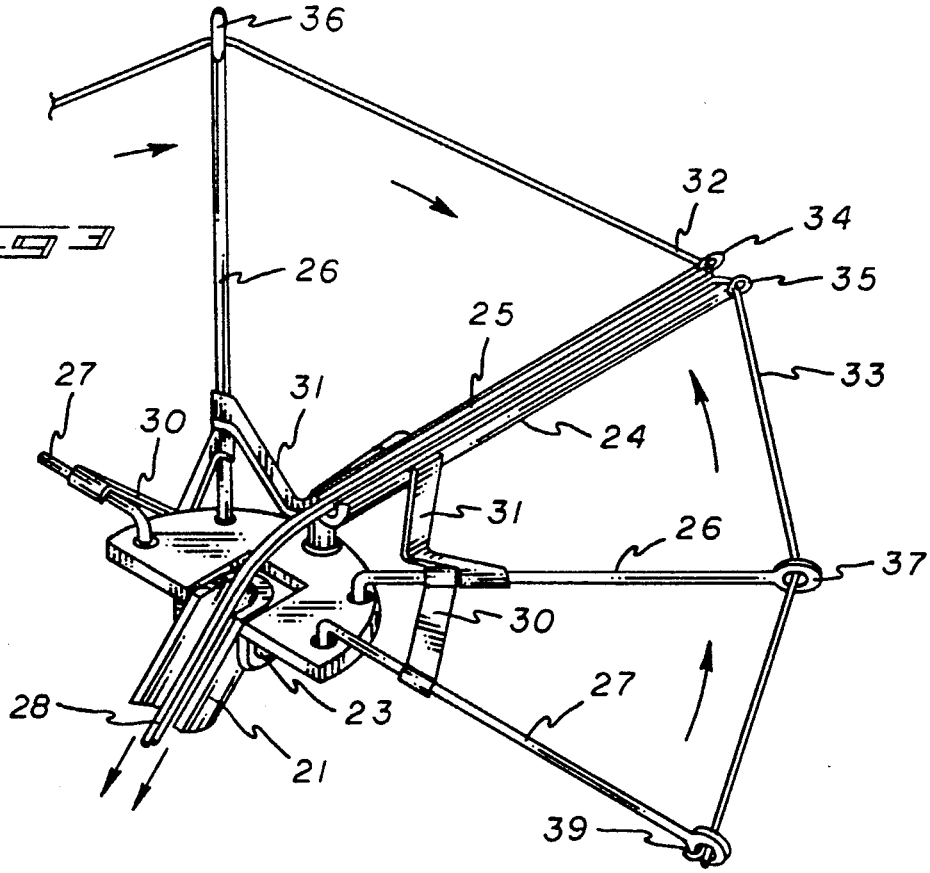
FIG. 3 is an isometric illustration of the rib structure relative to the support platform.
Figure 5:
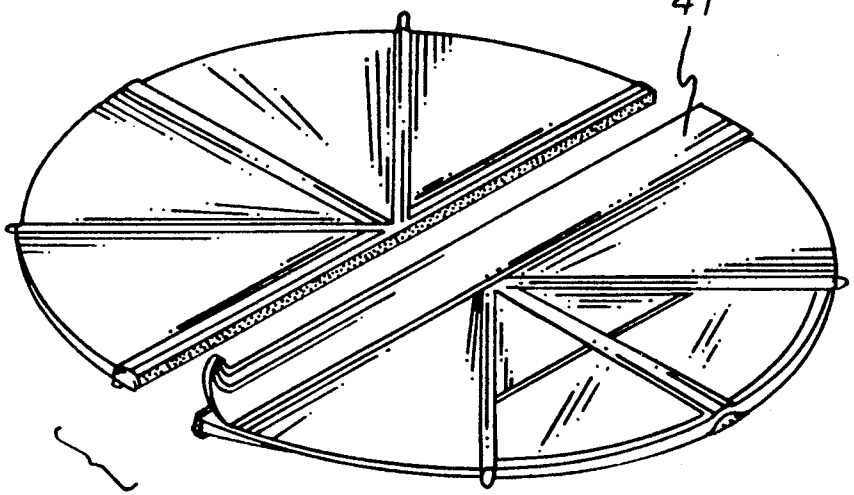
FIG. 5 is an isometric illustration of cooperative umbrella webs arranged for securement relative to one another by a fastening strip.

With reference now to the drawings, and in particular to FIGS. 1 to 7 thereof, a new and improved shoulder supported umbrella apparatus embodying the principles and concepts of the present invention and generally designated by the reference numeral 10 will be described.

Figure 4:
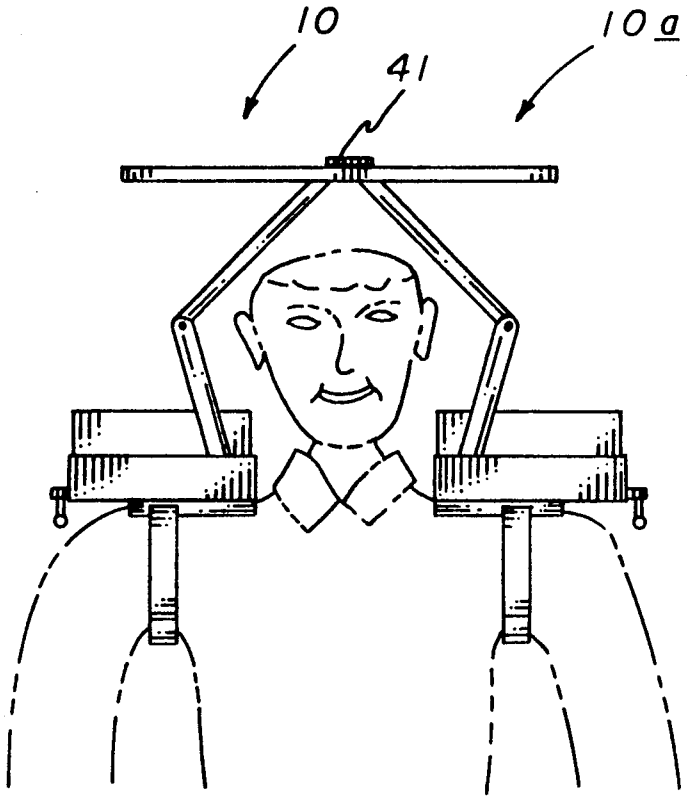
FIG. 4 is an orthographic view of a plurality of the shoulder supported umbrella structure arranged to form a circular array above an individual's head in use.

More specifically, the shoulder supported umbrella apparatus 10 is typically arranged for cooperation with a complementary further shoulder apparatus 10*a*, as indicated in FIG. 4. For purposes of discussion, the apparatus 10 is discussed, but it should be understood that the mirror image configuration of the further apparatus 10*a* is employed.

A support container 11 includes a container floor 12 having a side wall 13, including a forward end and a rear end wall, with a lid 14 hingedly mounted to the side wall 13 typically employing a latch 15, wherein the latch 15 may be of a magnetic type to permit the lid 14 to be secured readily to the side wall 13. A support leg 17 has a support leg first end 18 pivotally mounted about a first end axle 18*a*, with the leg 17 having its second end 19 including a second end axle 20 pivotally mounting an extension leg 21 at the extension leg first end, with the extension leg second end having a platform axle 23 (see FIG. 3) pivotally mounting a platform 22. The platform 22 includes a semi-annular periphery having a plurality of ribs projecting radially therefrom in a pivital relationship. The ribs include a primary rib 24 having a central rib trough 25 arranged for alignment with an extension leg trough of the extension leg 21. A plurality of central ribs are provided positioned on opposed sides of the primary rib 24, with a plurality of outer ribs that are longitudinally aligned relative to one another positioned on opposed sides of the platform 22, wherein the outer ribs 27 each include a first spring member 30 oriented in a biased orientation between the outer rib 27 and adjacent central rib 26, with a second spring member 31 oriented between each central rib 26 and an outer rib 27. A pull cable 28 is provided extending through the outer end wall of the container 11 terminating in a handle 29, wherein the pull cable 28 is directed through the support leg 17 and along the extension leg trough (see FIG. 3) for reception within the primary rib trough 25, whereupon the pull cable 28 splits into a first and second line 32 and 33 respectively, wherein the first line 32 and the second line 33 are directed through the respective first and second guide loops 34 and 35 mounted to the primary rib 24 at its outer distal end. Third and fourth guide loops 36 and 37 are mounted to outermost ends of opposed central ribs 26, with the first line terminating in a first line end 38 mounted to one of the outer ribs 27, with the second line 33 terminating in a second line end 39 secured to an outermost end of a further one of the outer ribs 27 such that upon tensioning of the pull cable 28 effects collapse of the ribs towards the primary rib 24 and interfolding of the platform about the platform axle 23, the support leg second end axle 20, and the first end axle 18*a* to interfold the structure within the container 11.

Collapsible web 40 is mounted coextensively over the ribs, in a manner as illustrated in FIG. 1, to permit interfolding of the web upon collapse of the organization.

As illustrated in the FIG. 4, the further umbrella apparatus 10*a* includes a like web structure, wherein a securement strip 41 typically employing cooperative hook and loop fasteners permits side-by-side securement of each of the webs when positioned in an edge-to-edge relationship.

Figure 7:
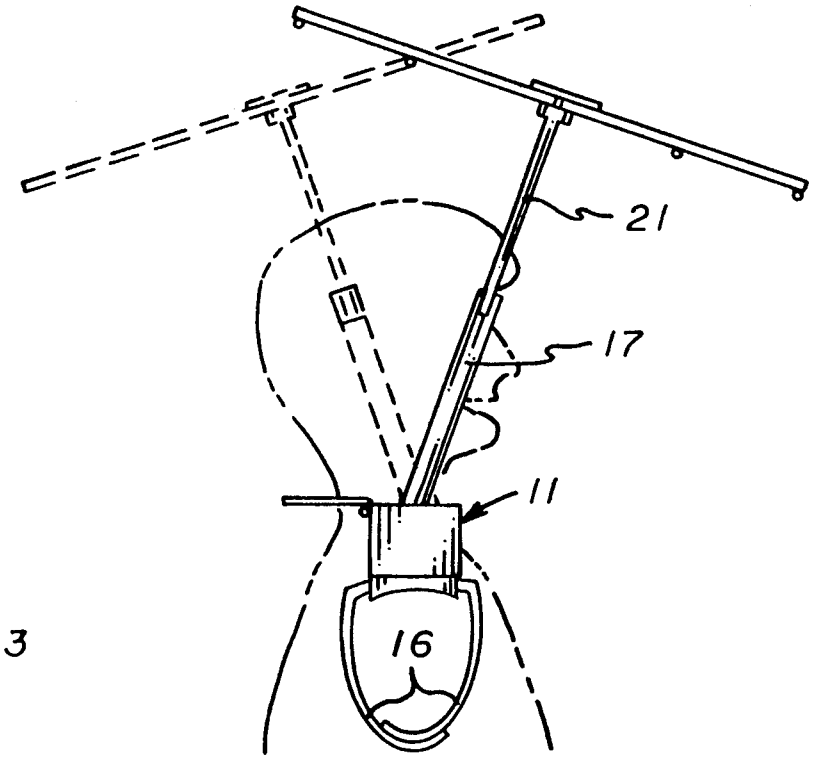
FIG. 7 is an orthographic view of the invention arranged for pivotal mounting relative to the container.
Figure 6:
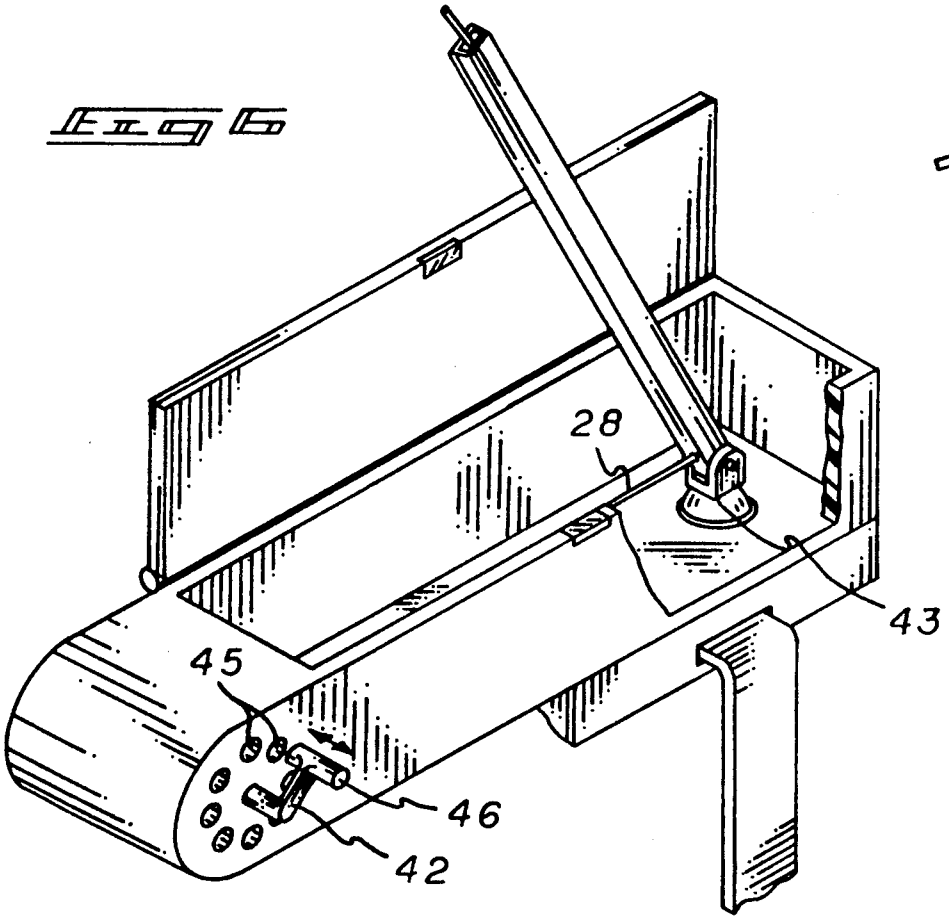
FIG. 6 is an isometric illustration of the invention employing a crank reeling structure.

The FIGS. 6 and 7 indicates the use of a swivel connection 43 at the support leg first end to permit pivoting of the umbrella structure in an angular orientation about the individual, as indicated in FIG. 7.

It should be noted that mounting straps 16 extending from the floor portion of the container includes cooperative hook and loop fastener structure to permit its securement about the shoulder portion of an individual, as indicated in FIGS. 4 and 7. Further, an accommodating floor extension may be provided with a concave surface to conform to an individual's shoulder for enhanced positioning of the container to the individual's shoulder in use.

With reference to the FIG. 1 and the FIG. 4 for example, it should be noted that the structure may be wholly supported on one shoulder rather than both. To this end, the mere mounting of the structure 10*a* to the structure 10, such as indicated in FIG. 4, absent the linkage and shoulder support structure will avail an individual of this capacity. The single shoulder mounting may be desirable for individuals requiring or preferring the single shoulder mount, where it should be understood the plural shoulder mount provides for equal balancing upon an individual's torso in use of the organization. Further, a solar powered fan (not shown) may be employed. Solar powered fans per se have been utilized in the prior art, where it should be understood that such may be employed by the instant invention to provide for enhanced ventilation during use of the structure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shoulder supported umbrella apparatus, comprising, at least one support container, having a container floor and a container side wall, the container side wall having a side wall front end wall and a side wall rear end wall, and a plurality of mounting straps secured to the container floor for securement about an individual's shoulder, and a support leg, having a support leg first end and a support leg second end, with the support leg first end axle pivotally mounting the support leg first end about the container floor adjacent the forward end wall, and the support leg second end having a second end axle, and an extension leg having extension leg first end pivotally mounted to the support leg about the second end axle, the extension leg including an extension leg second end having a platform, and a platform axle pivotally mountaing the platform to the extension leg second end, the platform including a semi-annular periphery having a primary rib medially of the semi-annular periphery, with a plurality of central ribs positioned on opposed sides of the primary rib, and a plurality of outer ribs that are diametrically aligned relative to one another, one positioned adjacent one of said central ribs, and a pull cable directed through the rear end wall of said container terminating in a pull cable handle, and the pull cable directed through the support leg and along the extension leg, the pull cable including a first pull cable line and a second pull cable line extending from said primary leg, wherein the first line is directed about one of said central ribs and one of said outer ribs, and the second line directed about one of said central ribs and one of said outer ribs, whereupon tensioning of said pull cable effects collapse of the extension leg and the support leg and interholding of the outer ribs and the central ribs towards the primary rib.

2. An apparatus as set forth in claim 1 wherein the extension leg includes an extension leg trough receiving the pull cable therethrough, and the primary rib includes a primary rib first guide loop receiving the first line therethrough, and a second guide loop receiving the second line therethrough, one of said central ribs includes a third guide loop receiving the first line therethrough, and one of said central ribs includes a fourth guide loop receiving a second line therethrough, and one of said outer ribs includes a first line end fixedly mounting the first line thereto, and one of said outer ribs includes a second line end securing said second line thereto.

* * * * *